US006723277B1

(12) United States Patent
Kurz et al.

(10) Patent No.: US 6,723,277 B1
(45) Date of Patent: Apr. 20, 2004

(54) METHOD FOR PRODUCING A MILLING DISC AND MILLING DISC PRODUCED ACCORDING TO THE INVENTIVE METHOD

(75) Inventors: Guido Kurz, Langerringen (DE); Herbert König, Schramberg (DE); Thomas Broghammer, Aichhalden (DE)

(73) Assignee: Karl Simon GmbH & Co. KG, Aichhalden (DE)

( * ) Notice: Subject to any disclaimer, the term of this patent is extended or adjusted under 35 U.S.C. 154(b) by 0 days.

(21) Appl. No.: 09/937,546

(22) PCT Filed: Jan. 22, 2000

(86) PCT No.: PCT/EP00/00476

§ 371 (c)(1),
(2), (4) Date: Mar. 21, 2002

(87) PCT Pub. No.: WO00/56487

PCT Pub. Date: Sep. 28, 2000

(30) Foreign Application Priority Data

Mar. 20, 1999 (DE) ..... 199 12 721

(51) Int. Cl.[7] ..... B22F 7/08
(52) U.S. Cl. ..... 419/5; 419/8; 419/38
(58) Field of Search ..... 419/5, 8, 38

(56) References Cited

U.S. PATENT DOCUMENTS 3,902,864 A * 9/1975 Nix et al. ..... 29/191.2
5,031,484 A * 7/1991 Packer ..... 76/108.6
5,333,520 A * 8/1994 Fischer et al. ..... 76/108.2
5,421,679 A * 6/1995 Pantzar et al. ..... 407/114
5,685,671 A * 11/1997 Packer et al. ..... 407/54
5,848,348 A * 12/1998 Dennis ..... 419/5
5,981,057 A * 11/1999 Collins ..... 428/334
6,273,924 B1 * 8/2001 Krenkel et al. ..... 51/307

FOREIGN PATENT DOCUMENTS

| | | | | |
|---|---|---|---|---|
| DE | 33 47 501 A | | 9/1985 | |
| EP | 0 046 209 A | | 2/1982 | |
| EP | 0 052 584 A | | 5/1982 | |
| EP | 0 052 584 | * | 5/1982 | ..... B22F/7/06 |
| WO | WO 98/24593 A | | 6/1998 | |

* cited by examiner

*Primary Examiner*—Daniel Jenkins
(74) *Attorney, Agent, or Firm*—Pauley Petersen & Erickson

(57) ABSTRACT

A method for producing a milling disc with embedded insets of hard metal, ceramics or other similar hard materials. The milling disc has a centrical bore in the base body of the disc. The tips of the insets protrude over the circumference of the disc body. The invention also relates to a milling disc produced according to the method wherein a powdery sintered metal material is filled into the recess of a mold pertaining to a compression molding die, and the mold matches the outer contour of the disc base body. Prefabricated insets are inserted into the sintered metal material and are positioned in the mold of the compression molding die. A green compact is subsequently pressed in the compression molding die and then taken out of the compression molding die. The green compact is sintered with the pressed insets and is subjected to hardening and/or surface treatment, if required. According to the milling disc, the resistance of the insets in the disc base body and the properties of the disc base body are improved.

19 Claims, 3 Drawing Sheets

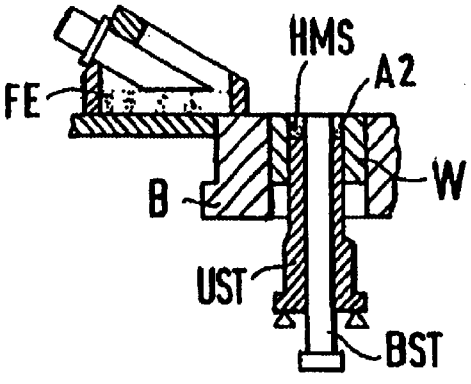
Fig.3
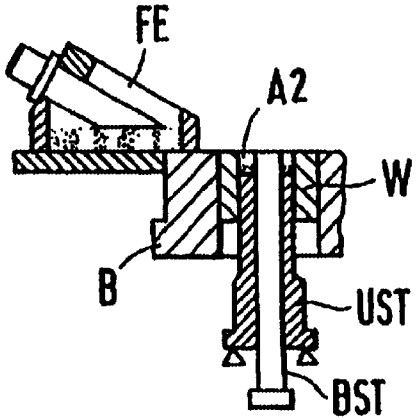
Fig.4
Fig.5
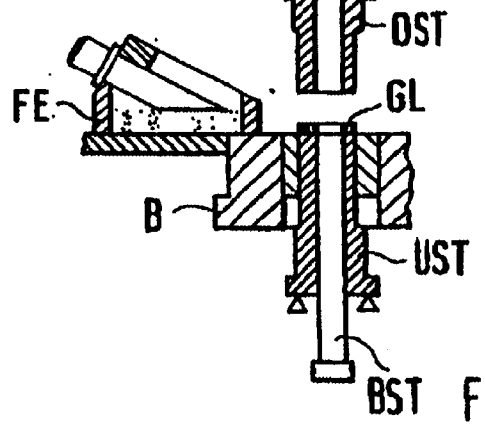
Fig.6
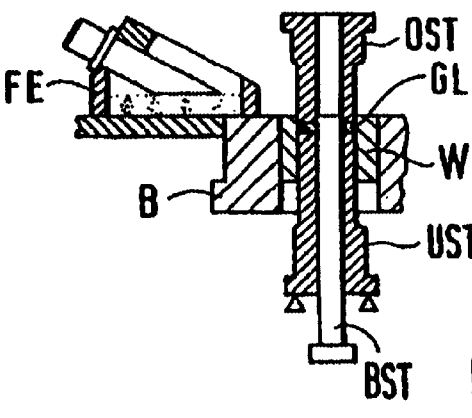
Fig.7
Fig.8

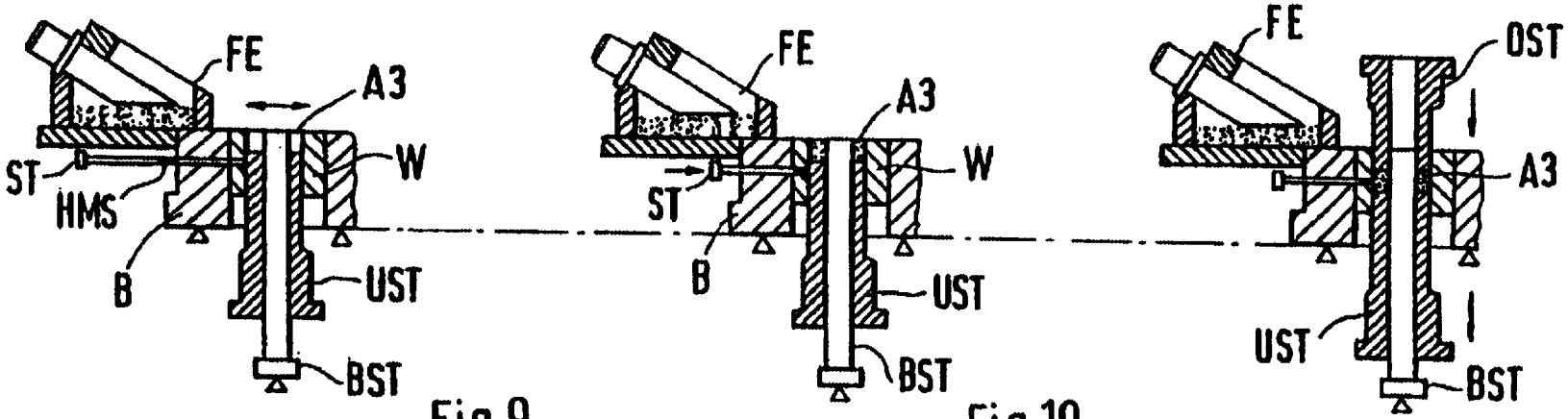
Fig.9
Fig.10
Fig.11
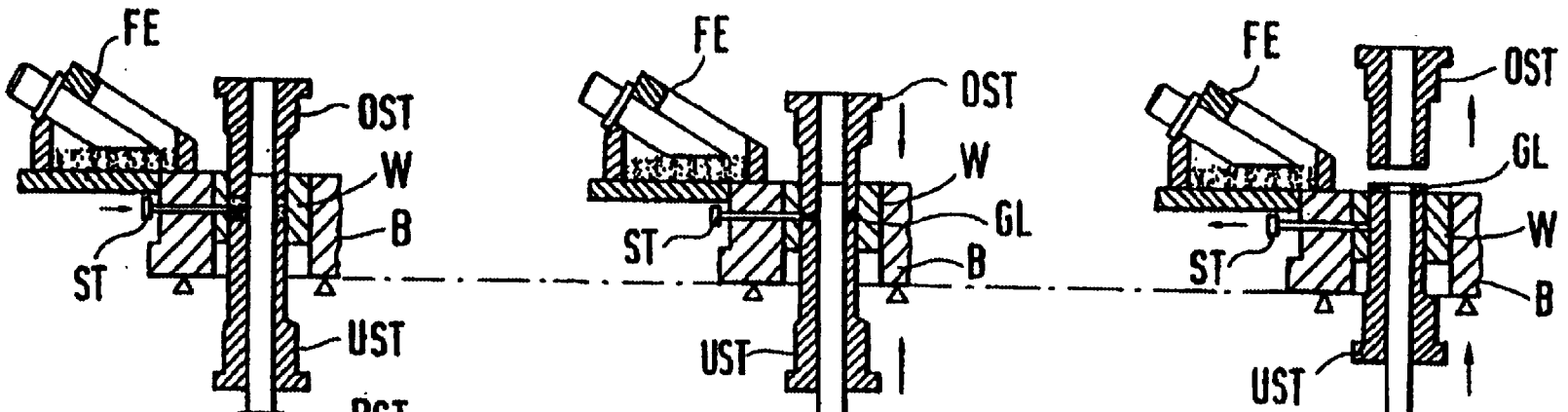
Fig.12
Fig.13
Fig.14

METHOD FOR PRODUCING A MILLING DISC AND MILLING DISC PRODUCED ACCORDING TO THE INVENTIVE METHOD

BACKGROUND OF THE INVENTION

1. Field of the Invention

This invention relates to a method for producing a milling disk with embedded inserts made of a hard alloy, a ceramic material, or similar hard materials, which has a centered bore in a base body of the disk and wherein tips of the inserts project at a circumference of the base body of the disk, and relates to a milling disk, which can be produced in accordance with the method.

2. Description of Related Art

Known milling disks of this type require an elaborate, time-consuming and expensive manufacturing process. For example, the base body of the disk is stamped out from a steel plate of a required thickness and is then deburred. The bores for the inserts, preferably embodied as hard alloy pins or the like with an appropriate round or uniform cross section, are inserted into the base body of the disk thus produced.

The hard alloy pins are pressed into the bores of the base body of the disk and soldered to the base body. Finally, at least the bore of the base body of the disk is inductively hardened and the milling disk is galvanized.

The milling disks produced in this way are not only expensive to produce, but they also have considerable disadvantages in their use. Since often only the area of the bore is inductively hardened, the outside of the milling disk only has a reduced hardness. The stamped base body of the disk is also not definitely level, because of which the bore cannot extend evenly, such as cylindrically. This hampers the reception of the bearing shaft and the stress on the disk bore causing a correspondingly great, uneven wear in this area. Moreover, this can lead to the formation of burs or whiskers in the area of the edges of the bore, which extend beyond the level surface of the base body of the disk. In case of an insufficient distance between the milling disks and the spacer disks this can lead to a blockage of the milling tool shaft when it is operated.

SUMMARY OF THE INVENTION

It is one object of this invention to provide a method for producing a milling disk of the previously mentioned type but with milling disks having a level outer area, great hardness and solid seating of the inserts that can be produced in a cost-effective manner.

This object is attained in accordance with this invention with a pulverulent metal sintering material that is filled into a receptacle of a mold of a compacting tool, which is matched to outer contours of the base body of the disk. Prefabricated inserts are placed into the poured-in metal sintering material and are positioned in the compacting tool. Following the introduction of the metal sintering material and positioning of the inserts in the compacting tool, a green compact is pressed in, and the green compact removed from the compacting tool with the inserts pressed into it is sintered and, if required, is afterwards subjected to hardening and/or surface treatment.

The inserts are prefabricated in a known manner, wherein a geometric shape is determined by the manner of application and use. The interlocking and frictional connection of the inserts with the base body of the disk is important. Thus a material is used for the base body of the disk which greatly shrinks during sintering and in this way holds the inserts frictionally in place with a press fit. The compacted and sintered base body of the disk can be hardened and, if required, can be subjected to a surface treatment, for example galvanically, without problems. The production process is considerably simplified and uses known method steps and devices.

The introduction of the metal sintering material and the positioning of the inserts in them can take place in different ways during the filling process. For one, initially only approximately half the filling process is performed. The inserts are introduced into the mold of the compacting tool and are positioned therein, and the filling process is completed thereafter or the inserts are maintained positioned in a radially adjustable manner in the mold of the compacting tool. Following the filling process, the inserts are positioned in the filled-in metal sintering material by means of radial displacement. However, further variations of the filling and positioning process are possible before the compacting process is initiated and performed.

In one embodiment which is particularly advantageous, a molybdenum-alloy sintering material is used as the metal sintering material, and the green compact is sintered at approximately 1200 to 1300° C. in a protective gas atmosphere for approximately 60 to 90 minutes. During the sintering process this material shrinks in the radial and axial direction by approximately 1.5 to 2%. Thus the sintered density is increased by approximately 03 to 0.5 g/cm$^3$ in comparison with the density of the green compact. This is a function of the initial density and the sintering parameters. The achieved residual porosity is less than 5 volume-percent.

The support of the inserts in the base body of the disk can be improved with hard alloy pins used as inserts which have at least one section with a reduced cross section in the axial direction, or hard alloy pins can be used as inserts each with a cross section that continuously tapers toward the tip.

The sintered green compacts are subjected to hardening with the addition of carbon. The low residual porosity can be precisely controlled by case-hardening the edges, which permits a defined hardening depth. Surface hardnesses of 60 Rockwell C, or 710 VPN, are possible, and the hardening depth advantageously is up to 0.8 mm, and hardness is greater than 600 VPN.

Based on the low residual porosity of less than 5 volume-percent, it is possible to subject the sintered milling disks to a surface treatment without pretreatment, for example electrogalvanization.

The milling disks produced in accordance with this method are distinguished in that prefabricated hard alloy pins, which have an undercut in the axial direction and are embedded in a sintered base body of the disk, are fixed in place in the form of inserts by shrinking the base body of the disk during sintering. Soldering of the hard alloy pins with the base body of the disk is omitted, but yet an improved support of the hard alloy pins in the base body of the disk is achieved. The sintered milling disk with the fixed hard alloy pins can be case-hardened and subjected to a surface treatment. To ease the insertion of the bearing shaft into the bore of the base body of the disk, the edges of the bore in the base body of the disk have bezels.

BRIEF DESCRIPTION OF THE DRAWINGS

This invention is explained in greater detail in view of an exemplary embodiment represented in the drawings, wherein:

FIG. 3 is a schematic view of a compacting device for producing a milling disk in accordance with FIGS. 1 and 2, in a first filling position;

FIG. 4 shows the partially filled compacting device in a second filling position;

FIG. 5 shows the partially filled compacting device in the insertion position for the inserts embodied as hard alloy pins;

FIG. 6 shows the compacting device after the second filling process;

FIG. 7 shows the compacting device in the compacting position;

FIG. 8 shows the compacting device, opened following the compacting process, with the green compact in the removal position; and FIGS. 9 to 14 show a differently operated compacting device in the various positions during filling, positioning, compacting and removal.

DESCRIPTION OF PREFERRED EMBODIMENTS

Figure 1:
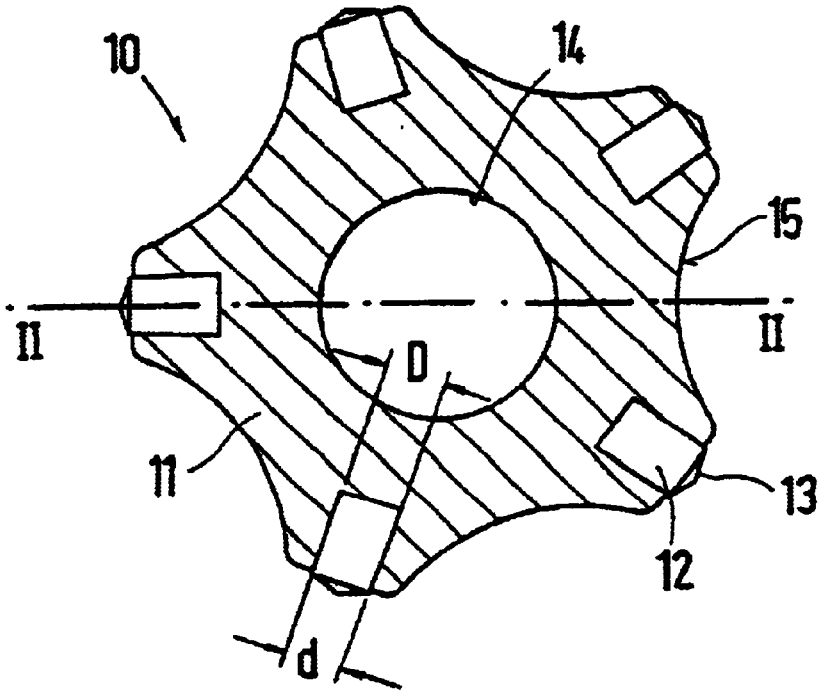
FIG. 1 shows a milling disk in a horizontal section.
Figure 2:
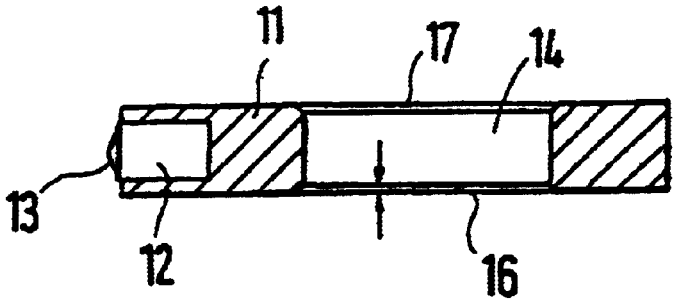
FIG. 2 is a longitudinal section taken through the milling disk of FIG. 1, along the line II—II.

The sections in FIGS. 1 and 2 show an exemplary embodiment of a milling disk 10 manufactured in accordance with the method of this invention. The sintered base body 11 of the disk with its centered bore 14 has a circumferential contour with five radially projecting arms. A hard alloy pin 12, which continuously tapers toward the tip 13, is fixed in place in each arm and is frictionally supported by means of the shrinkage occurring while sintering the base body 11 of the disk. Support is interlockingly improved by means of the conical shape of the hard alloy pins 12. The end sections, each with a diameter D is widened in relation to the tip section of the diameter d, form undercuts in the base body 11 of the disk, which provide improved support. The tips 13 of the hard alloy pins 12 project away from the arms of the base body 11 of the disk at the circumference.

The method for producing the milling disk 10 in accordance with FIGS. 1 and 2 is explained in view of FIGS. 3 to 8, wherein a compacting device, comprising a lower die UST, a bore die BST and an upper die OST and a mold W, and having a filling device FE is employed. The mold W, which defines the outer contour 15 of the milling disk 10, is maintained in a base element B in the exemplary embodiment. The lower die UST matched to this contour can be displaced in the mold W and can be adjusted in two filling positions in accordance with FIGS. 3 and 4. The mold W and the lower die UST form a receptacle A1 in FIG. 3, with a height that approximately corresponds to half the thickness of the base body 11 of the disk. The receptacle A1 is filled with pulverulent metal sintering material, for example molibdenum-containing sintering metal, by means of the filling device FE. Thus, the filling device FE can be moved above the receptacle A1.

When the receptacle A1 is filled, the lower die UST is displaced downward, as shown in FIG. 4. The receptacle A2 formed in the process then is only half filled. In this case the bore die BST maintains its position and ends flush with the free side of the receptacles A1 and A2.

As FIG. 5 shows, the compacting device maintains its position in accordance with FIG. 4 in the insertion position of the inserts HMS. The inserts HMS are embedded in the poured-in fill of the sintering material and are positioned with their tips inserted into receptacles in the mold W.

When the embedding and positioning of the inserts HMS is completed, the receptacle A2 is completely filled, as shown in FIG. 6. Following the second filling process, the lower die UST and the upper die OST in the tool W are moved against each other and the filling with the inserts HMS is compacted into a green compact GL, as shown in FIG. 7.

Thereafter, the compacting device is opened and the green compact GL is ejected from the mold W, for example by further displacement of the lower die UST, so that it can be subjected to the further process steps, such as sintering, hardening and, if required, a surface treatment.

In accordance with the method of FIGS. 9 to 14, a receptacle A3 in accordance with FIG. 9 is formed in the filling position. Hard alloy pins HMS are maintained in position, displaceably guided in channels in the base B and the mold W of the compacting tool. In the filling position shown in FIG. 9, the channels are closed by the lower die UST. The bore die BST terminates flush with the top of the mold W. The receptacle A3 is filled with metal sintering material by displacing the filling device FE horizontally, as shown in FIG. 10. The receptacle A3 is adapted to the required amount of metal sintering material for the green compact. The receptacle A3 is aligned with the dies ST containing the hard alloy pins HMS to be displaced by moving the lower die UST and the upper die OST downward, as shown in FIG. 11. Subsequently the dies ST are displaced in the direction toward the bore die BST and the hard alloy pins HMS are displaced into the introduced metal sintering material sufficiently far so that they assume their position for the milling disk to be produced, as shown in FIG. 12. The lower die UST and the upper die OST are moved toward each other, and in the process the metal sintering material, together with the hard alloy pins HMS held in their position, are compacted into a green compact GL, as shown in FIG. 13. If the compacting device is opened and the lower die UST is moved upward, the compacted green compact GL is ejected from the compacting device, as shown in FIG. 14.

The subsequent sintering of the green compact GL with the hard alloy pins 12 occurs in both cases in a protective gas atmosphere at 1200 to 1300° C. for approximately 60 to 90 minutes, so that the sinter base body 11 of the disk has a residual porosity of less than 5 volume-percent.

The sintered milling disk 10 is hardened in a hardening arrangement with the addition of carbon, wherein hardnesses of 60 Rockwell C, or 710 VPN, are achieved. The hardening depth can extend up to 0.8 mm at a hardness of greater than 600 VPN.

If required, the sintered and hardened milling disk 10 can also be subjected to a surface treatment, for example by electrogalvanization.

The milling disk 10 thus produced is cost-effective and optimally meets the set requirements, wherein the excellent support of the inserts, for example hard alloy pins, in the disk body, and the properties of the basic body of the disk in particular, advantageously differ from the milling disk produced in the known manner.

It is important that a metal sintering material be used which has sufficient shrinkage following sintering in order to achieve a frictionally connected support of the embedded hard alloy pins. The support can also be improved by an appropriate shape of the hard alloy pins with an interlocking connection. The shape of the milling disk, the number of inserts and their shape can be arbitrarily selected. The metal sintering material and the material for the inserts can be varied without departing from the method in accordance with this invention, wherein the parameters of the compacting and sintering processes are adapted to them.

What is claimed is:

1. In a method for producing a milling disk with embedded inserts made of a hard alloy, a ceramic material, or a similar hard material, which has a centered bore in a base body of a disk and wherein tips of the inserts project at a circumference of the base body of the disk, the improvement comprising:

filling a pulverulent metal sintering material into a receptacle (A1, A2, A3) of a mold (W) of a compacting tool (W, UST, BST, OST) which is matched to outer contours of the base body of the disk (11), placing prefabricated inserts (HMS) into a poured-in metal sintering material and in the mold (W) of the compacting tool (W, UST, BST, OST), after introducing the metal sintering material and positioning the inserts (HMS) in the compacting tool (W, UST, BST, OST) pressing in a green compact (GL), and removing the green compact (GL) from the compacting tool (W, UST, BST, OST) with the inserts (HMS) pressed into the green compact (GL) and, if required, afterwards at least one of hardening and surface treating the green compact (GL), and prefabricated hard alloy pins (12) having an undercut in an axial direction and being embedded in a sintered base body of the disk (11) are fixed in place as the inserts (HMS) by shrinking the base body of the disk (11) during sintering.

2. In the method in accordance with claim 1, wherein initially only approximately half a filling process is performed, the inserts (HMS) are introduced into the mold (M) of the compacting tool (W, UST, BST, OST) and are positioned therein, and the filling process is completed.

3. In the method in accordance with claim 1, wherein the sintered milling disk (10) is case-hardened and subjected to a surface treatment.

4. In the method in accordance with claim 3, wherein edges of the bore (14) in the base body of the disk (11) have bezels (16, 17).

5. In the method in accordance with claim 1, wherein edges of the bore (14) in the base body of the disk (11) have bezels (16, 17).

6. In a method for producing a milling disk with embedded inserts made of a hard alloy, a ceramic material, or a similar hard material, which has a centered bore in a base body of a disk and wherein tips of the inserts project at a circumference of the base body of the disk, the improvement comprising:

filling a pulverulent metal sintering material into a receptacle (A1, A2, A3) of a mold (W) of a compacting tool (W, UST, BST, OST) which is matched to outer contours of the base body of the disk (11), placing prefabricated inserts (HMS) into a poured-in metal sintering material and in the mold (W) of the compacting tool (W, UST, BST, OST), after introducing the metal sintering material and positioning the inserts (HMS) in the compacting tool (W, UST, BST, OST) pressing in a green compact (GL), and removing the green compact (GL) from the compacting tool (W, UST, BST, OST) with the inserts (HMS) pressed into the green compact (GL) and, if required, afterwards at least one of hardening and surface treating the green compact (GL), and a molybdenum-alloy sintering material is employed as the metal sintering material, and the green compact (GL) is sintered at approximately 1200 to 1300° C. in a protective gas atmosphere for approximately 60 to 90 minutes.

7. In the method in accordance with claim 6, wherein hard alloy pins (12) are used as the inserts (HMS) each with a cross section that continuously tapers toward the tip.

8. In the method in accordance with claim 6, wherein the sintering process is performed up to a residual porosity of less than 5 volume-percent of the base body of the disk (11).

9. In the method in accordance with claim 6, wherein the sintered green compact (GL) is hardened by the addition of carbon to a hardnesses of 60 Rockwell C and 710 VPN.

10. In the method in accordance with claim 6, wherein the sintered milling disk (10) is subjected to a galvanic surface treatment without pre-treatment.

11. In a method for producing a milling disk with embedded inserts made of a hard alloy, a ceramic material, or a similar hard material, which has a centered bore in a base body of a disk and wherein tips of the inserts project at a circumference of the base body of the disk, the improvement comprising:

filling a pulverulent metal sintering material into a receptacle (A1, A2, A3) of a mold (W) of a compacting tool (W, UST, BST, OST) which is matched to outer contours of the base body of the disk (11), placing prefabricated inserts (HMS) into a poured-in metal sintering material and in the mold (W) of the compacting tool (W, UST, BST, OST), after introducing the metal sintering material and positioning the inserts (HMS) in the compacting tool (W, UST, BST, OST) pressing in a green compact (GL), and removing the green compact (GL) from the compacting tool (W, UST, BST, OST) with the inserts (HMS) pressed into the green compact (GL) and, if required, afterwards at least one of hardening and surface treating the green compact (GL), and hard alloy pins are used as the inserts (HMS) which have at least one section with a reduced cross section in an axial direction.

12. In the method in accordance with claim 11, wherein the inserts (HMS) are maintained positioned in a radially adjustable manner in the mold (W) of the compacting tool (W, UST, BST, OST), and following the filling process the inserts (HMS) are positioned in the filled-in metal sintering material by radial displacement.

13. In the method in accordance with claim 12, wherein a molybdenum-alloy sintering material is employed as the metal sintering material, and the green compact (GL) is sintered at approximately 1200 to 1300° C. in a protective gas atmosphere for approximately 60 to 90 minutes.

14. In the method in accordance with claim 13, wherein hard alloy pins are used as the inserts (HMS) which have at least one section with a reduced cross section in an axial direction.

15. In the method in accordance with claim 13, wherein hard alloy pins (12) are used as the inserts (HMS) each with a cross section that continuously tapers toward the tip.

16. In the method in accordance with claim 15, wherein the sintering process is performed up to a residual porosity of less than 5 volume-percent of the base body of the disk (11).

17. In the method in accordance with claim 16, wherein the sintered green compact (GL) is hardened by the addition of carbon to a hardnesses of 60 Rockwell C and 710 VPN.

18. In the method in accordance with claim 17, wherein hardening is performed with a hardening depth of up to 0.8 mm and a hardness greater than 600 VPN.

19. In the method in accordance with claim 18, wherein the sintered milling disk (10) is subjected to a galvanic surface treatment without pre-treatment.

* * * * *